US008215043B1

(12) United States Patent
Roy

(10) Patent No.: US 8,215,043 B1
(45) Date of Patent: Jul. 10, 2012

(54) FRAME BACK RETAINER

(75) Inventor: Armand E. Roy, Attleboro, MA (US)

(73) Assignee: Craft, Inc., South Attleboro, MA (US)

( * ) Notice: Subject to any disclaimer, the term of this patent is extended or adjusted under 35 U.S.C. 154(b) by 0 days.

(21) Appl. No.: 13/340,611

(22) Filed: Dec. 29, 2011

Related U.S. Application Data

(63) Continuation-in-part of application No. 12/859,014, filed on Aug. 18, 2010.

(60) Provisional application No. 61/235,036, filed on Aug. 19, 2009.

(51) Int. Cl.
*A47G 1/06* (2006.01)

(52) U.S. Cl. ..... 40/790; 40/796; 292/241

(58) Field of Classification Search ..... 40/796, 40/790; 411/501; 292/DIG. 35, 241, 281
See application file for complete search history.

(56) References Cited

U.S. PATENT DOCUMENTS

| | | | | | |
|---|---|---|---|---|---|
| 509,626 | A | * | 11/1893 | Patterson | 40/790 |
| 1,041,776 | A | * | 10/1912 | Gibson | 40/732 |
| 1,222,468 | A | * | 4/1917 | Rosen | 40/796 |
| 2,798,327 | A | * | 7/1957 | Dibb | 40/790 |
| 4,088,053 | A | * | 5/1978 | Tyree | 411/501 |
| 6,125,567 | A | * | 10/2000 | Roy | 40/790 |
| 7,272,903 | B2 | | 9/2007 | Roy | |

* cited by examiner

*Primary Examiner* — Gary Hoge
(74) *Attorney, Agent, or Firm* — Barlow, Josephs & Holmes, Ltd.

(57) ABSTRACT

A frame back retainer for a multi-use frame includes a tab-like structure and a fastening structure. The tab-like structure defines an aperture at a first end and defines a substantially flattened profile at a second end for engaging the multi-use frame. The tab-like structure includes at least one securing arm depending from the tab-like structure. The fastening structure is positioned through the aperture of the tab-like structure and mounted to the multi-use frame. The fastening structure defines a raised pedestal profile from a surface of the multi-use frame. The at least one securing arm engages an outer edge of the fastening structure to rotatably attach the fastening structure to the tab-like structure. In operation, the user rotates the tab-like structure relative to the fastening structure about an axis to engage or disengage the second end of the tab-like structure within the multi-use frame.

9 Claims, 16 Drawing Sheets

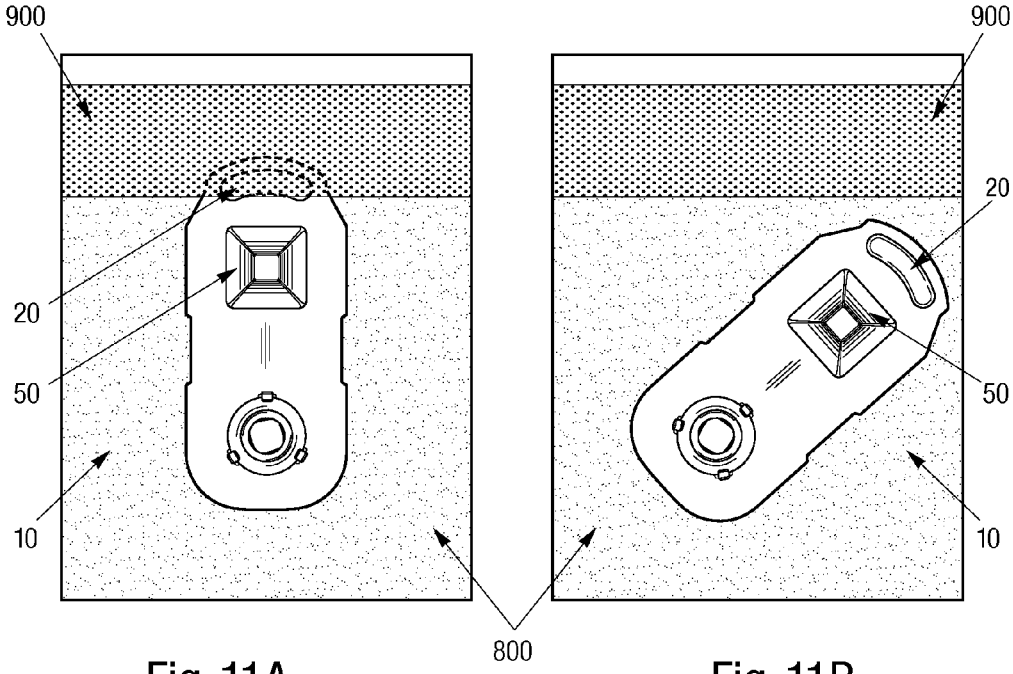
Fig. 11A
Fig. 11B
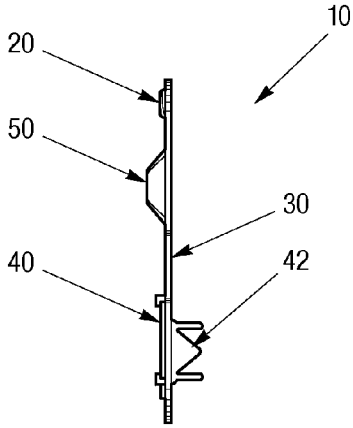
Fig. 11C

FRAME BACK RETAINER

CROSS REFERENCE TO RELATED APPLICATIONS

This continuation-in-part non-provisional patent application is related to and claims priority from earlier filed U.S. Non-Provisional patent application Ser. No. 12/859,014 filed Aug. 18, 2010, and earlier filed U.S. Provisional Patent Application No. 61/235,036 filed Aug. 19, 2009, all of which are incorporated herein by reference.

BACKGROUND OF THE INVENTION

The present invention relates to multi-use frame hardware and methods of manufacturing the same. In the multi-use frame industry, there are various types of multi-use frame hardware which includes turn buttons for maintaining a frame back inside a multi-use frame with a photo or artwork sandwiched therebetween.

The present invention relates to turn button hardware. Prior art turn buttons are typically tab-like structures that are attached to a multi-use frame back. The tabs are pivotally attached to the back so that they may pivot in place. The free ends of the turn button tabs, when in a locked position, reside within a groove in the multi-use frame to secure it in place. When pivoted to an open position, the tabs are no longer engaged with the frame so the multi-use frame back can be freely removed to gain access to the back of the multi-use frame itself to insert or remove a picture therefrom. Also, a turn button can be attached to the multi-use frame itself and pivoted or bent to communicate with the multi-use frame back.

As illustrated in FIGS. 1-2, prior art turn buttons are typically attached to the multi-use frame back by a rivet or simply punched therethrough. This attachment dictates the pivoting tension of the turn button itself. For example, a very secure rivet connection will result in a very tight turn button making it very difficult to turn for the user of the frame. A loose attachment makes it easier to manipulate the turn button but the connection will also be loose making a poor locking connection and/or making it possible for the turn button to fall off of the multi-use frame back completely.

Sometimes, the turn button may fail to reliably and predictably secure the frame back to the frame for a variety of reasons. On occasion, the frame back is made of material, such as soft cardboard, lacking sufficient strength to properly retain the turn button therein. Upon installation, the rivet may be improperly flared allowing the turn button to disengage. Also, a consumer may not properly place the turn button in the correct position to secure the frame back to the frame.

Therefore, there is a need for a repetitive, reliable, and predictable way of securing the frame back to the frame to prevent disengagement of the frame back from the frame. Also, there is a need for securing the frame back to the multi-use frame which is convenient and easy to use for a consumer.

BRIEF SUMMARY OF THE INVENTION

The present invention preserves the advantages of existing frame back retainers while providing new advantages not found in currently available frame back retainers and overcoming many disadvantages of such currently available frame back retainers. The present invention provides a frame back retainer for multi-use frames which provides a repetitive, reliable, and predictable way of securing the frame back to the frame to prevent disengagement of the frame back from the frame. Also, the frame back retainer secures the frame back to the multi-use frame which is convenient and easy to use for a consumer.

The frame back retainer includes a tab-like structure and a fastening structure which is secured to a frame back of a multi-use frame. The multi-use frame may be selected from a group consisting of digital picture frames, picture frames, and frame for displaying documents, photographs, or other materials. The multi-use frame includes a front and rear portion of the frame and a frame back. The frame back is positioned within the rear portion of the frame. The tab-like structure is mounted to the frame back. In one embodiment, the tab-like structure is pivotally mounted to the frame back for pivotal movement about an axis.

The tab-like structure defines an aperture at a first end and defines a graduated ramp portion at a second end. The graduated ramp portion is tapered on both ends of the ramp portion to allow engagement of the ramp portion within the kerf from either a left or right direction or clockwise or counterclockwise. The tab-like structure includes at least one securing arm depending from the tab-like structure near the aperture. The graduated ramp portion of the tab-like structure frictionally engages a frame kerf between the frame and the frame back to secure the frame back in place when the tab-like structure pivots or rotates relative to the frame back.

In addition, the tab-like structure includes an angular offset portion between the graduated ramp portion and the aperture to allow the graduated ramp portion to frictionally engage the frame kerf without requiring assistance of additional layers of material. Also, the tab-like structure has a raised portion near the graduated ramp portion for manipulation by a user's fingers to move the tab-like structure to the left or to the right.

The fastening structure is positioned through the aperture of the tab-like structure and mounted to the multi-use frame. In one embodiment, the tab-like structure defines a recessed area along an outer periphery of the aperture for receiving the fastening structure. The fastening structure defines a raised pedestal profile from a surface of the multi-use frame for allowing rotation of the tab-like structure relative to the fastening structure. The at least one securing arm engaging an outer edge of the fastening structure to rotatably attach the fastening structure to the tab-like structure.

In operation, the user rotates the tab-like structure relative to the fastening structure about an axis to engage or disengage the graduated ramp portion within the frame kerf of the multi-use frame to secure the frame back to the frame.

In another embodiment, the frame back retainer includes a tab-like structure and a fastening structure. The tab-like structure defines an aperture at a first end and defines a substantially flattened profile at a second end for engaging the multi-use frame. The tab-like structure includes at least one securing arm depending from the tab-like structure. The fastening structure is positioned through the aperture of the tab-like structure and mounted to the multi-use frame. The fastening structure defines a raised pedestal profile from a surface of the multi-use frame. The at least one securing arm engages an outer edge of the fastening structure to rotatably attach the fastening structure to the tab-like structure. In operation, the user rotates the tab-like structure relative to the fastening structure about an axis to engage or disengage the second end of the tab-like structure within the multi-use frame.

It is therefore an object of the present invention to provide a frame back retainer with repetitive, predictable, and simple securing of a frame back to a multi-use frame.

It is a further object of the embodiment to provide a frame back retainer with a tab-like structure to frictionally engage within the multi-use frame for securing the frame to the frame back.

Another object of the embodiment is to provide a frame back retainer with an angular offset portion offset portion to spring-bias the tab-like structure and allow the graduated ramp portion to frictionally engage the frame kerf without requiring assistance of additional layers of material.

Another object of the embodiment is to provide a fastening structure defining a raised pedestal profile from a surface of the object for allowing rotation of the tab-like structure relative to the fastening structure.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the frame back retainer are set forth in the appended claims. However, the frame back retainer, together with further embodiments and attendant advantages, will be best understood by reference to the following detailed description taken in connection with the accompanying drawing Figures.

FIG. 11A is a top view of FIG. 1 with the frame back retainer in an engaged position within the kerf of the multi-use frame;

FIG. 11B is a top view of FIG. 1 with the frame back retainer in a disengaged position from the kerf of the multi-use frame;

FIG. 11C is a side view of the frame back retainer of FIG. 1;

DETAILED DESCRIPTION OF THE PREFERRED EMBODIMENTS

Referring now generally to FIGS. 3-14, the frame back retainer 10 of the instant invention is illustrated. The present invention provides a frame back retainer 10 with a ramp portion 20 or ramp friction pad that provides a repetitive, reliable, and predictable way of securing a frame back 800 to a multi-use frame 900 to prevent disengagement of the frame back 800 from the frame 900. In addition, the present invention provides the frame back retainer 10 for securing the frame back 800 to the multi-use frame 900 which is convenient and easy to use for a consumer.

Figure 1:
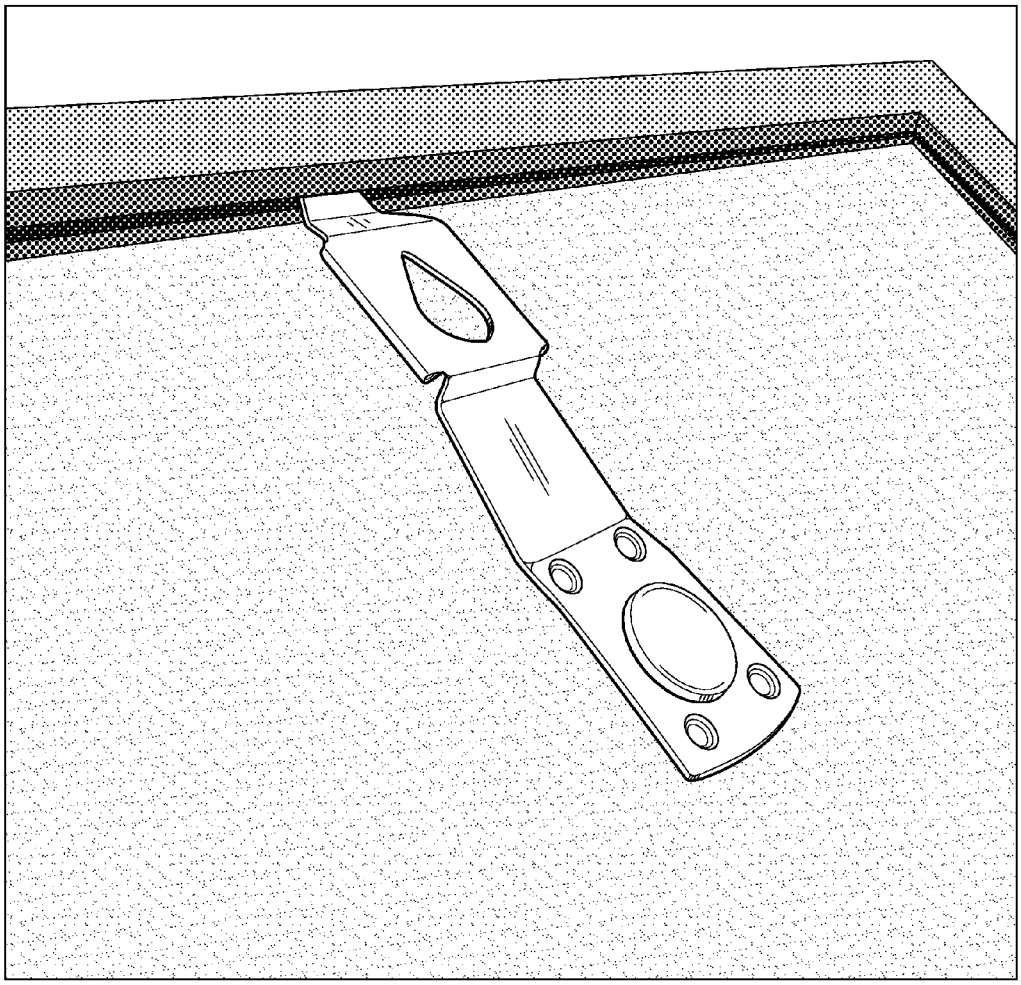
Fig. 1 Prior Art
FIG. 1 is a perspective view of a prior art turn button engaged within a kerf of a frame.
Figure 2:
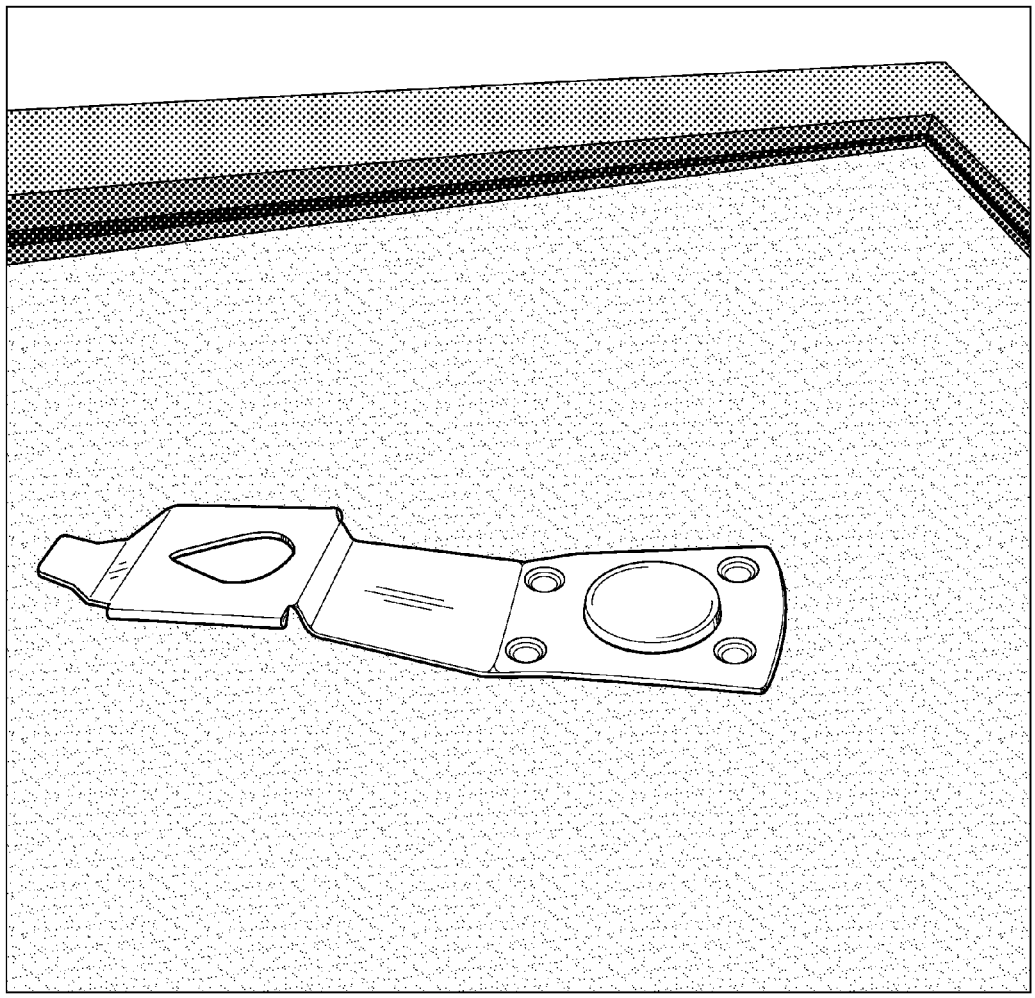
Fig. 2 Prior Art
FIG. 2 is a perspective view of a prior art turn button disengaged from a kerf of a frame.
Figure 3:
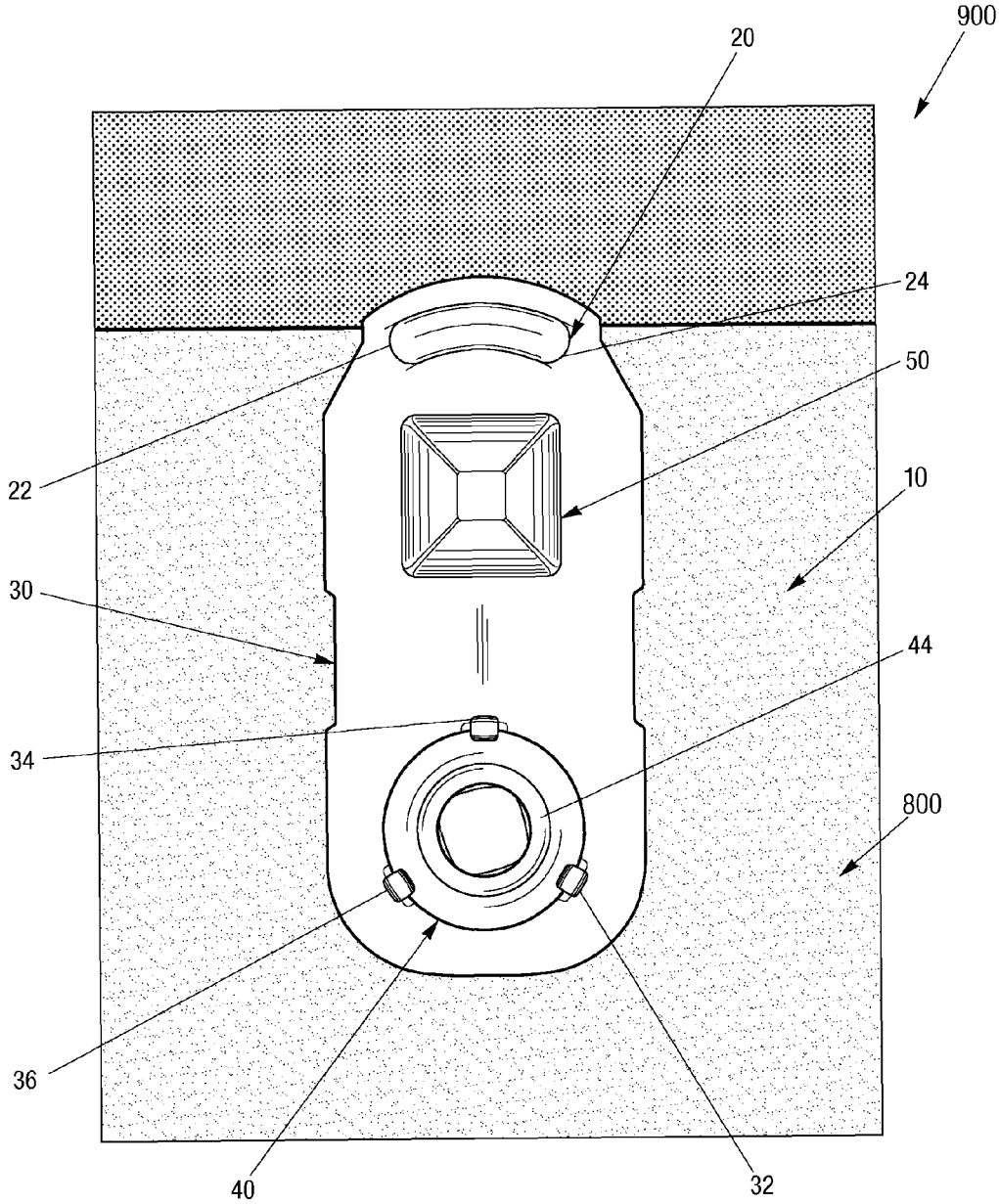
FIG. 3 is a top view of the frame back retainer constructed in accordance with the teachings of the present invention.
Figure 4:
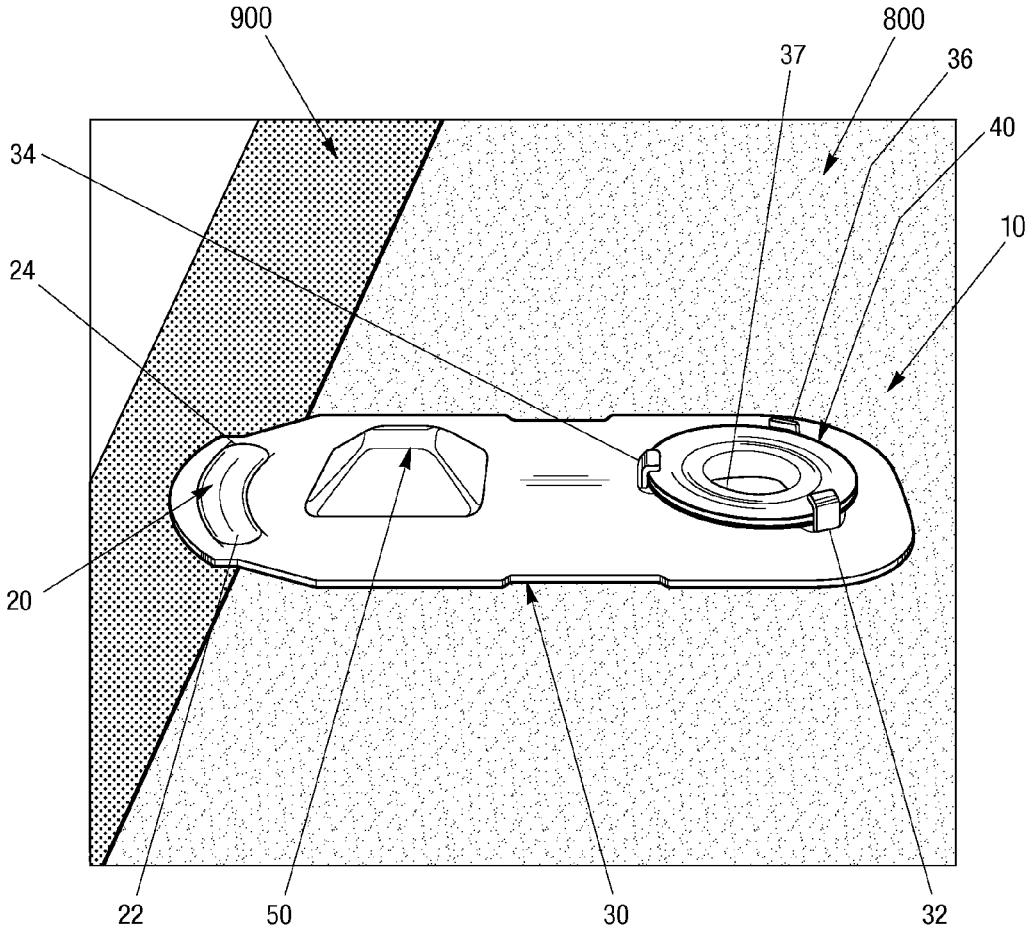
FIG. 4 is a top side view of the frame back retainer of FIG. 1.
Figure 5:
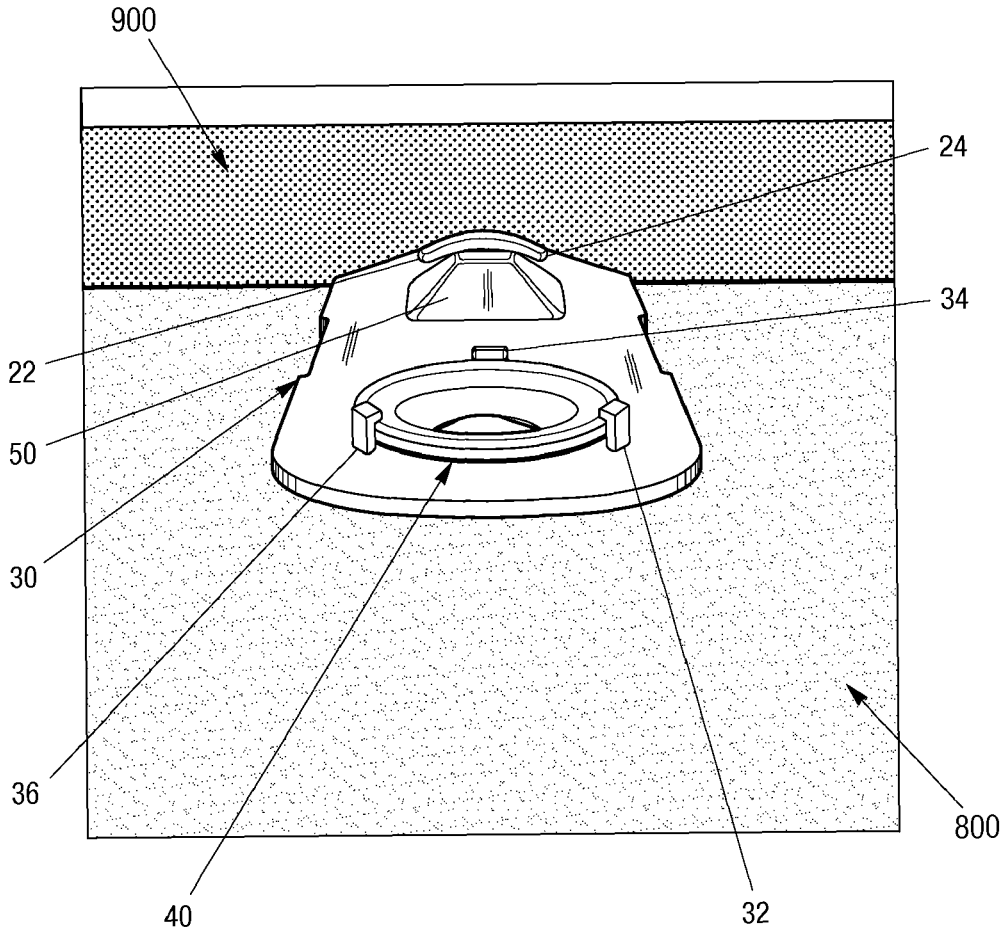
FIG. 5 is a rear view of the frame back retainer of FIG. 1.
Figure 6:
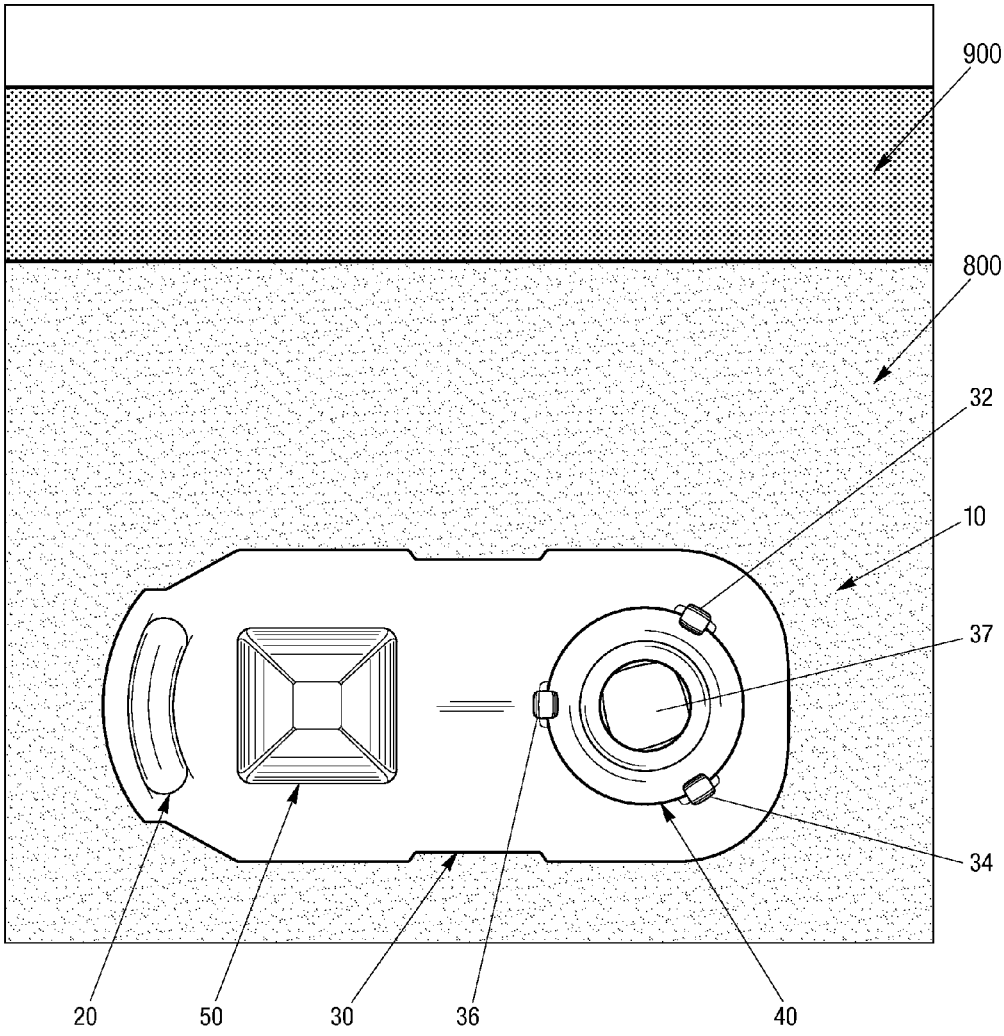
FIG. 6 is a top view of the frame back retainer of FIG. 1 with the frame back retainer in a disengaged position.
Figure 7:
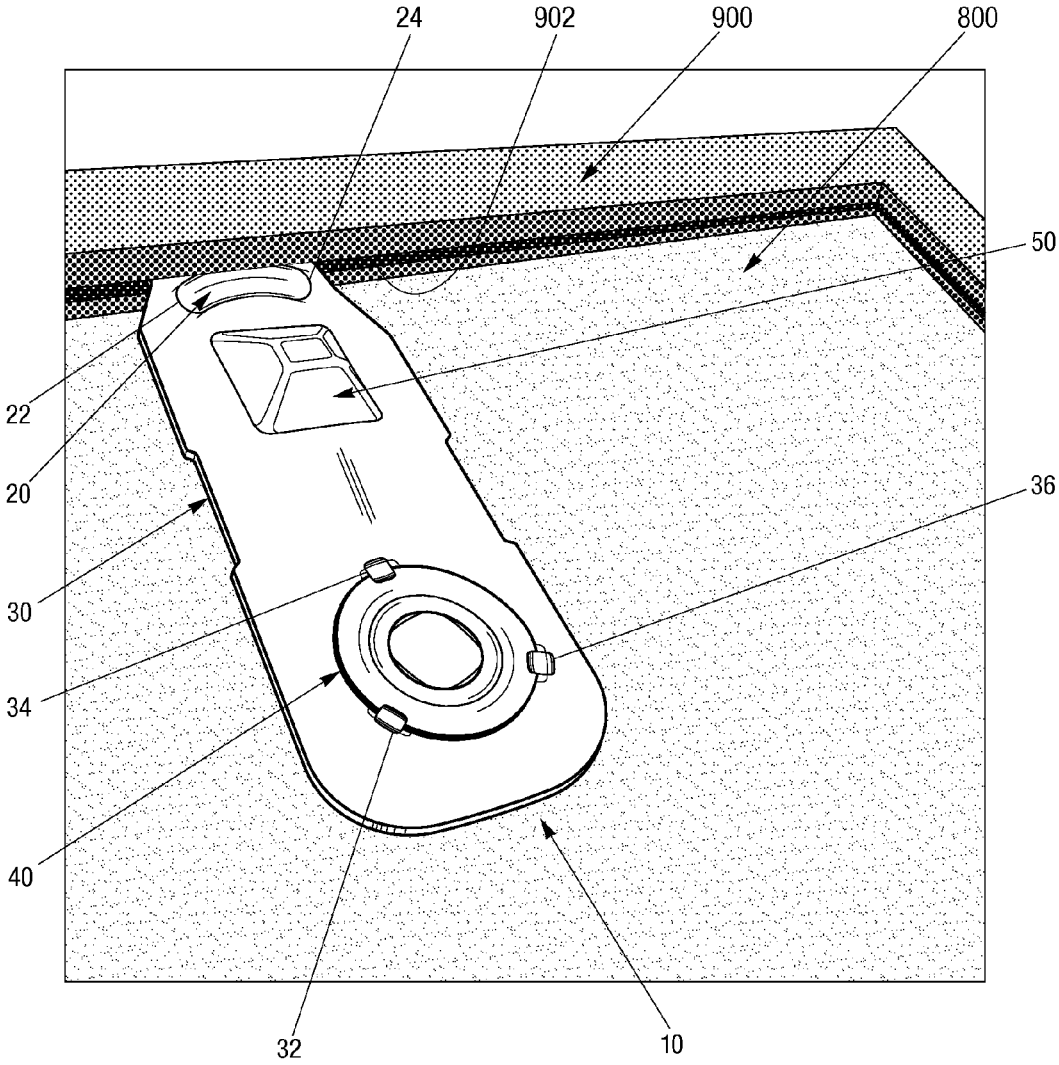
FIG. 7 is a top view of the frame back retainer of FIG. 1 with the frame back retainer in a engaged position within a kerf of a frame.
Figure 8:
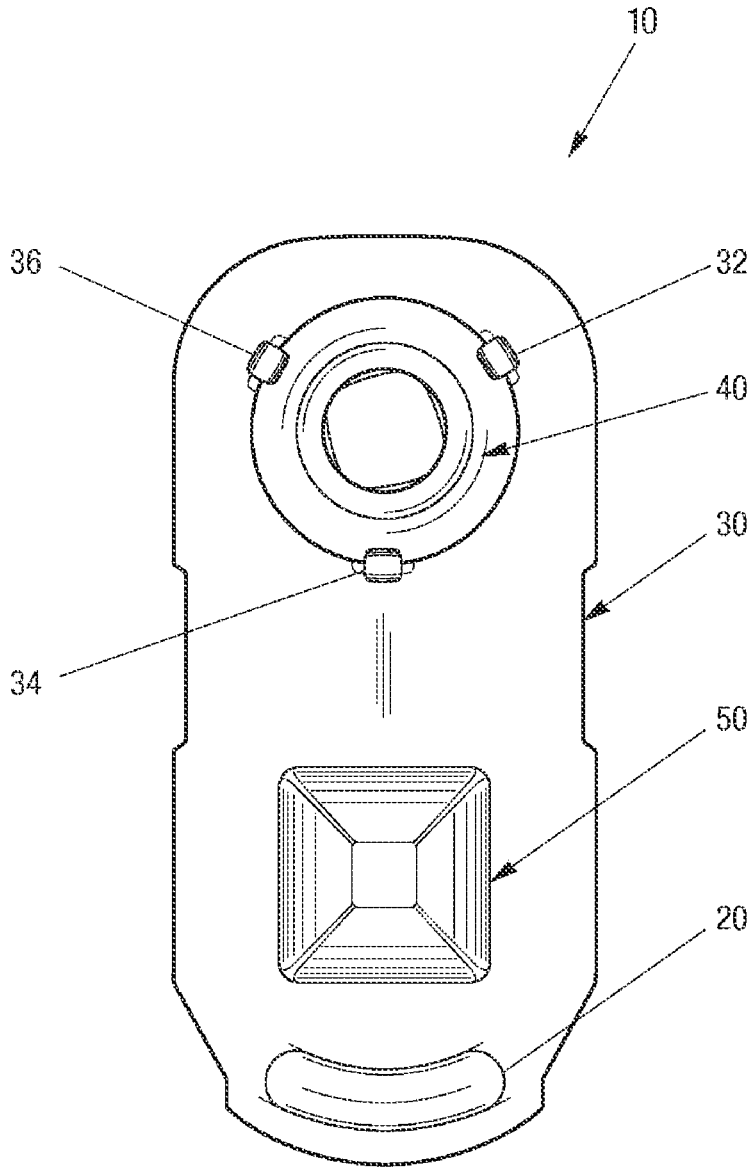
FIG. 8 is a top view of the frame back retainer of FIG. 1.
Figure 9:
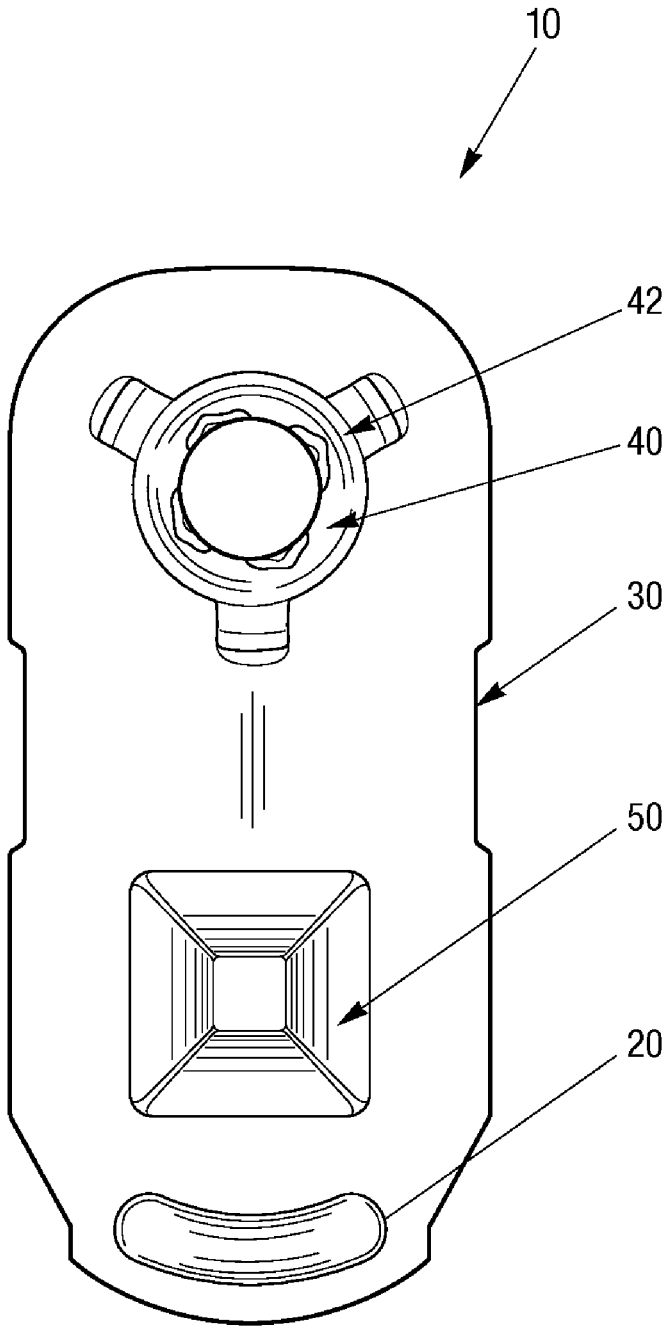
FIG. 9 is a bottom view of the frame back retainer of FIG. 1.
Figure 10:
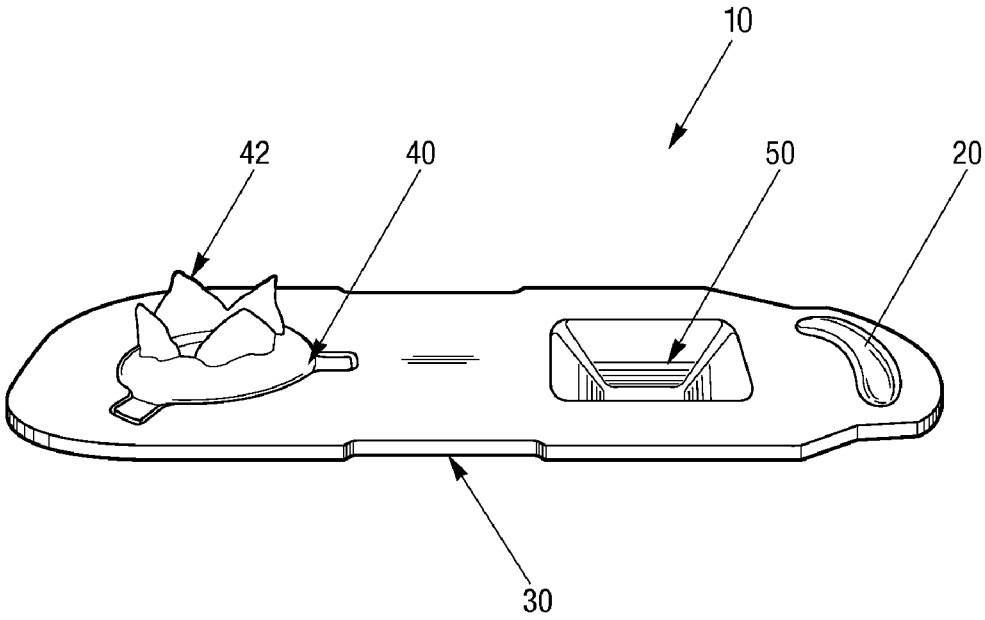
FIG. 10 is a side bottom view of the frame back retainer of FIG. 9.

Referring generally to FIGS. 3-14, the present invention discloses a frame back retainer 10 that is superior to known retainers by being far superior in construction and ease of use. Referring to FIG. 3, the frame back retainer 10 includes a tab-like structure 30 or pivoting tab and a fastening structure 40 which is secured to a frame back 800 of a multi-use frame 900. The tab-like structure 30 or pivoting tab has a rectangular shape or other desired shape and defines an aperture 37 for receiving a fastening structure 40 at a first end and defines a ramp portion 20 or ramp friction pad at a second end. In one embodiment, a surrounding area of the aperture 37 is configured to seat the fastening structure 40—such as a swivel rosette fastener element 42 with a tiered or raised pedestal profile 44. The surrounding area of the aperture 37 is a recessed region 38 to securely seat a swivel rosette fastener element 42 with a raised or tiered pedestal profile 44.

The tab-like structure 30 is mounted to the frame back 800. In one embodiment, the tab-like structure 30 is pivotally mounted to the frame back for pivotal movement about an axis. The tab-like structure 30 defines an aperture 37 at a first end and defines a ramp shaped portion 20 or friction pad at a second end. In one embodiment, the ramp shaped portion 20 defines a graduated and raised profile with an arctuate or radial shape. Both left end 22 and right end 24 of the ramp friction pad 20 define a graduated or inclined surface to facilitate the inserting of the ramp friction pad 20 within a kerf 902 between the frame back 800 and the frame 900 from either a clockwise or counter-clockwise direction. In a preferred embodiment, the ramp friction pad 20 or ramp portion provides sufficient height to frictionally fit within the kerf 902. Of course, the ramp friction pad 20 may be adjustable for height, width, and graduation at opposite ends depending upon the size of the kerf 902, desired frictional fit, and resistance.

In another embodiment, the ramp friction pad 20 is tapered on both ends of the ramp friction pad 20 to allow engagement of the ramp friction pad 20 or ramp portion within the kerf 902 from either a left or right direction or, alternatively, clockwise or counterclockwise. The ramp portion 20 of the tab-like structure 30 frictionally engages a frame kerf between the frame 900 and the frame back 800 to secure the frame back 800 in place when the tab-like structure 30 pivots or rotates relative to the frame back 800.

The tab-like structure 30 includes at least one securing arm 32, 34, 36 depending from the tab-like structure 30 near the aperture 37. The securing arm 32, 34. 36 is curled over or bent to securely engage a surface of the fastening structure 40. In a preferred embodiment, the tab-like structure 30 includes three securing arms 32, 34, 36. The number of securing arms 32, 34, 36 is adjustable depending upon a fastening structure 40 and size of the aperture 37.

Also, the tab-like structure 30 has a raised portion 50 or operating knob near the graduated ramp friction pad 20 for manipulation by a user's fingers to move the tab-like structure 30 to the left or to the right. In one embodiment, the raised portion 50 is an operating knob 50 with a raised profile. In a preferred embodiment, the operating knob 50 defines a peripheral square or rectangular shape with a centrally raised portion similar to a pyramid-like structure. The operating knob 50 serves more than one purpose. The first purpose of the operating knob 50 is to provide a user a substantially raised surface for moving the tab-like structure 30 from an engaged to a disengaged position within the kerf 902 of the frame 900. The second purpose of the operating knob 50 is to act as a stabilizer or spacer for smoothly coiling product in parallel to rosette element or fastening structure 40 during the manufacturing or coiling process.

The second component of the frame back retainer 10 is the fastening structure 40. The fastening structure 40 is positioned through the aperture 37 of the tab-like structure 30 and mounted or firmly attached, permanently or temporarily, to the frame back 800. To facilitate the fastening structure 40 securing within the aperture 37, the tab-like structure 30 defines a recessed area 38 (FIG. 12) along an outer periphery of the aperture 37 for receiving the fastening structure 40. In one embodiment, the fastening structure 40 includes the swivel rosette fastener element 42 having a plurality of prongs which are secured into the material of the frame back 800 and a raised or tiered pedestal 44 extending above the frame back 800. The fastening structure 40 defines a raised pedestal profile 44 from a surface of the frame back 800 for allowing rotation of the tab-like structure 30 relative to the fastening structure 40.

Securing rosettes to multi-use frame backs of various materials need not be discussed herein as they are known in the art. However, it is contemplated that the fastening structure 40 may also be a flared cylinder or other fastener capable of securing the tab-like structure 30 to the frame back 800 while allowing a raised, pedestal profile 44 above the surface of the frame back to provide sufficient clearance between the tab-like structure 30 and a surface of the frame back 800. At least one securing arm 32, 34, 36 is bent over or cured to engage an outer edge of the fastening structure 40 to rotatably attach the fastening structure 40 to the tab-like structure 30.

The fastening structure 40 further includes a raised or tiered pedestal profile 44 from a surface of the frame back 800 for allowing rotation of the tab-like structure 30 relative to the fastening structure 40. The pedestal profile 44 provides additional separation between the surface of the frame back 800 and the tab-like structure 30 to prevent degradation of the frame back 800. In addition, the raised or tiered pedestal profile 44 of the fastening structure 40 provides a resistant force to the raised ramp friction pad 20 or ramp portion when it is engaged within a kerf 902 or peripheral groove of the frame 900. Also, the raised or tiered pedestal profile 44 allows a user an ability to easily manipulate the tab-like structure 30 from an engaged to a disengaged position within the kerf 902 of the frame 900.

The fastening structure 40 is attached to the frame back 800 which is made of materials having different structure, form, thickness, and density. Depending upon the material used in the frame back 800, the fastening structure 40 may be selected, separate and apart from the tab-like structure 30, to provide a secure connection between the frame back 800 and the tab-like structure 30. The fastening structure 40, being a separate piece or component, from the tab-like structure 30 allows the frame back retainer 10 to adapt to the type of frame 900, size of the kerf 902, materials used in the frame back 800, desired friction fit of the tab-like structure 30 within the kerf 902, and a multitude of other factors which affect the ability to retain the frame back 800 to the frame 900.

In operation, the user rotates the tab-like structure 30 relative to the fastening structure 40 about an axis to engage or disengage the graduated ramp portion 20 within the frame kerf of the multi-use frame to secure the frame back to the frame. In operation, a user manipulates the operating knob 50 to rotate the tab-like structure 30 relative to the fastening structure 40 about an axis to engage or disengage the ramp friction pad 20 or ramp portion within the kerf 902. Referring to FIG. 11A, when the tab-like structure 30 is engaged within the kerf 902 or peripheral groove of the frame 900, the ramp friction pad 20 is frictionally fit within the kerf 902 to prevent the removal of the frame back 800 from the frame 900. Referring to FIG. 11B, when the tab-like structure 30 is swiveled or moved out of the kerf 902, the ramp friction pad 20 is removed from the kerf 902 and the frame back 800 can be removed from the frame 900.

Figure 12:
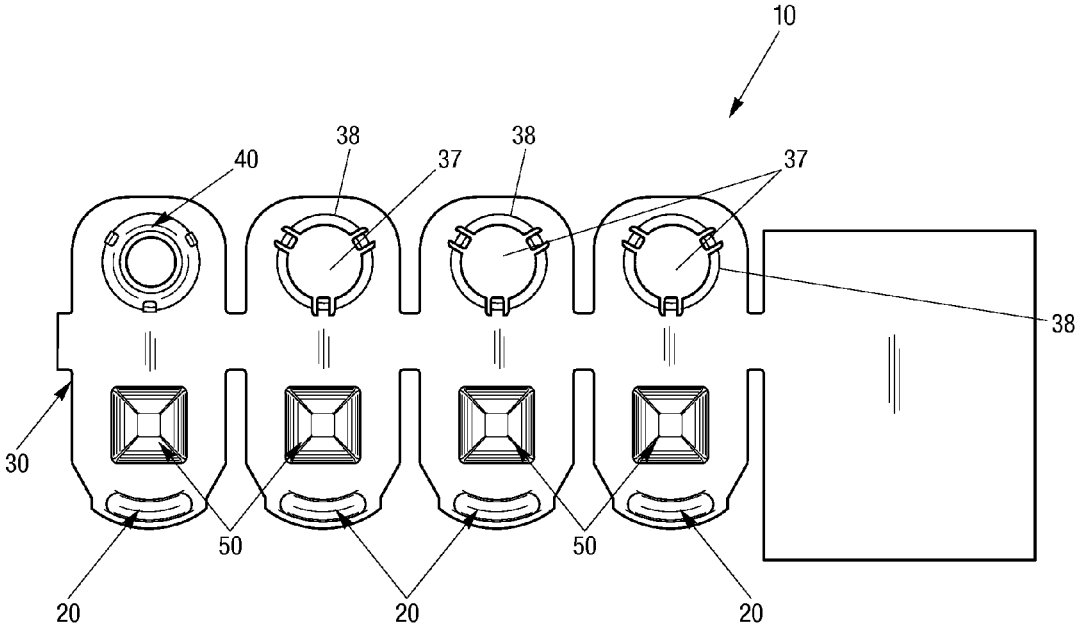
FIG. 12 is a top view of multiple frame back retainers illustrating various stages of construction.
Figure 13:
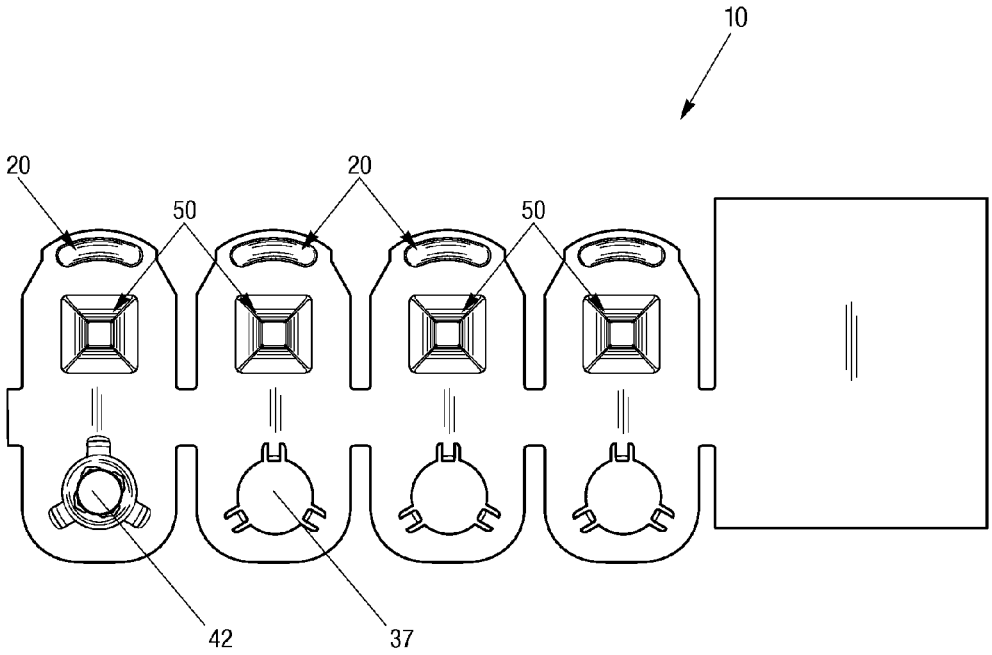
FIG. 13 is a bottom view of multiple frame back retainers of FIG. 12 illustrating various stages of construction.

Referring to FIGS. 12 and 13, the frame back retainer 10 of the present invention can be manufactured in a number of different ways. As illustrated, a plate and tab-like structure 30 are shown in various stages of completion. In one embodiment, the material used in the frame back retainer 10 is 0.022"-0.024" thick steel which is pre-painted to a desired color. The frame back retainer 10 will be presented in a strip form of coil-feedable frame back retainers that is adapted for use with a four head application machine. Preferably, a coil fed strip of material is provided to facilitate continuous mass production of frame back retainers 10 on the frames. The frame back retainer 10 may be manufactured "bandolier" style for economic installation by single or multi-head equipment. The frame back retainer 10 can be parted from the "bandolier" reading and installed in diverse backing materials, such as cardboard, mdf, corrugated, and plastic. Alternatively, devices can be formed from individual blanks.

Figure 14A:
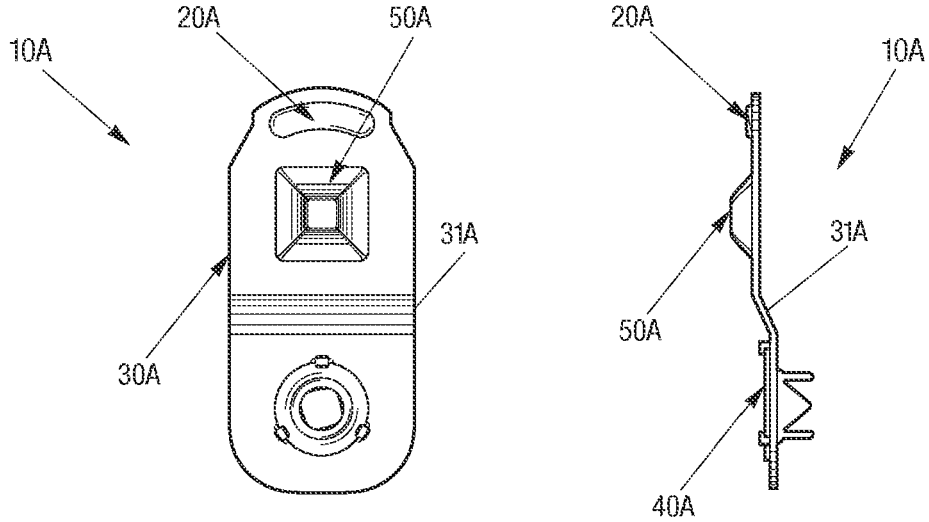
FIG. 14A is a top view of an alternative frame back retainer having an angular offset and a side view of the frame back retainer having an angular offset portion.
Figure 14B:
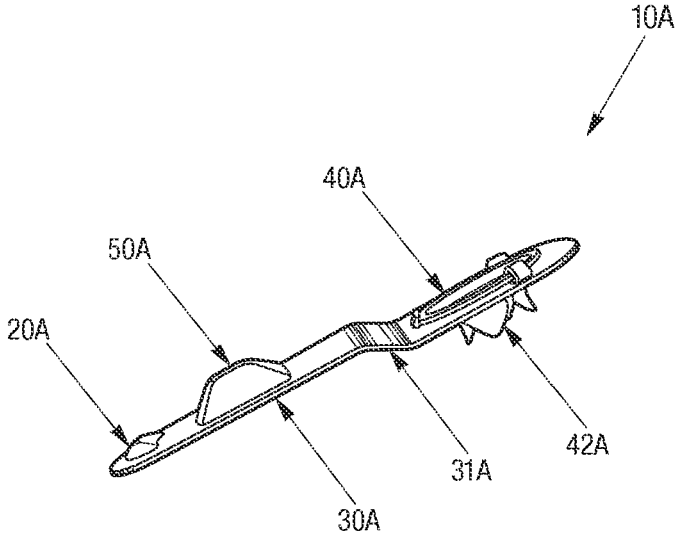
FIG. 14B is a perspective view an alternative embodiment of the frame back retainer having an angular offset portion.

Referring to FIGS. 14A and 14B, an alternative embodiment of the frame back retainer 10A is illustrated. The tab-like structure 30A includes an angular offset portion 31A between the graduated ramp portion 20A and the aperture 37A to allow the graduated ramp portion 20A to frictionally engage the frame kerf 902 without requiring assistance of additional layers of material. For example, in one embodiment, the angular offset portion 31A of the tab-like structure 30 is offset 0.080 inches as illustrated in FIG. 14B. Of course, it is contemplated that the angular offset 31A may be adjusted according to the size of the kerf 902 and the ramp portion 20A to provide a more secure connection between the frame back 800 and the frame 900. As a result of the angular offset portion 31A, the tab-like structure 30A has spring-bias to facilitate engagement within the kerf 902 of the frame 900. In one embodiment, the tab-like structure is spring-biased upwardly. By offsetting the tab-like structure 30A, a user may use the frame back 800 and the frame 900 with or without matting materials due to the spring-bias of the tab-like structure 30A.

The multi-use frame 900 may be selected from a group consisting of digital picture frames, picture frames, and frame for displaying documents, photographs, or other materials. The multi-use frame 900 includes a front and rear portion of the frame and a frame back 800. Typically, the frame back 900 is positioned within the rear portion of the frame 900.

The frame back retainer 10 has a number of advantages over the prior art. First, the frame back retainer 10 includes a ramp friction pad 20 or ramp portion which gradually guides the tab-like structure 30 into the kerf to prevent the removal of the frame back 800 from the frame 900. Second, the frame back retainer 10 includes a tab-like structure 30 or pivoting tab which rotates or swivels about a fastening structure 40 having a raised pedestal 44 that is firmly implanted into the frame back 800 to prevent the release of the fastening structure 40 from the frame back 800 over time. Third, the frame back retainer 10 includes an operating knob 50 to allow the user to engage or disengage the retainer and also to stabilize the retainer 10 during the manufacturing process. Therefore, the frame back retainer 10 provides a reliable and durable closure which can be adapted to a variety of multi-use frames.

Figure 15:
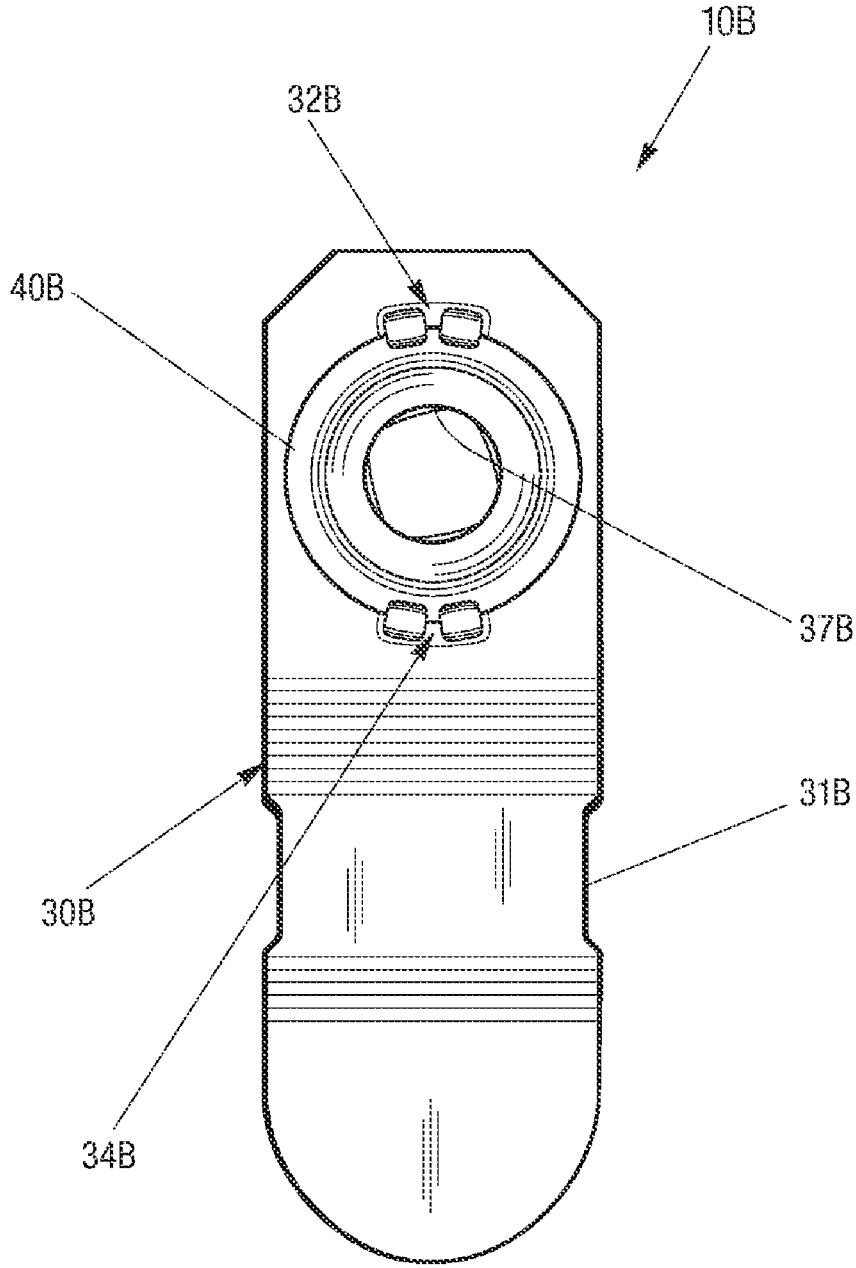
FIG. 15 is a top view of an alternative frame back retainer having an angular offset portion.
Figure 16:
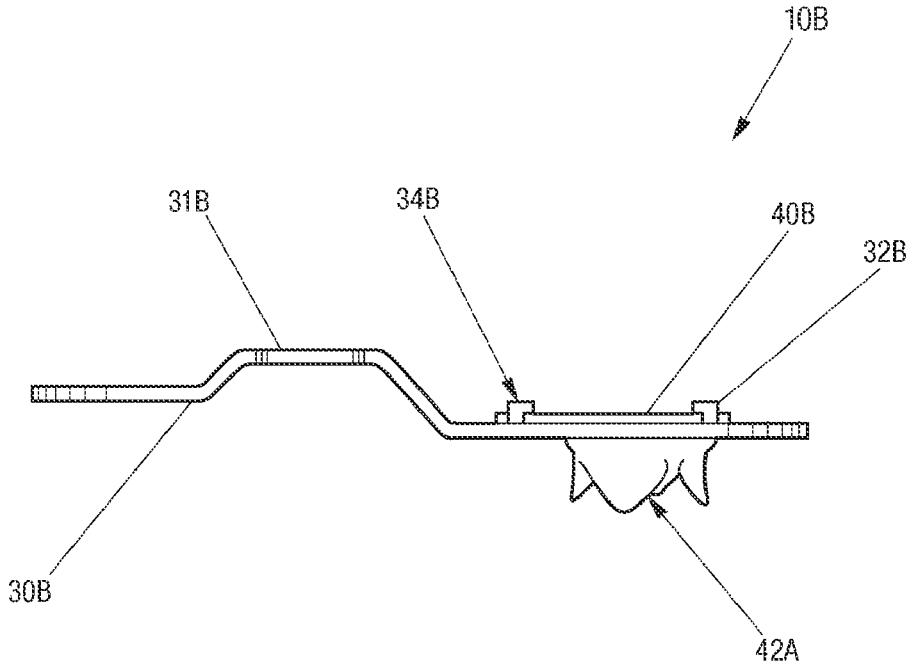
FIG. 16 is an elevated side view of the alternative frame back retainer of FIG. 15.

Referring to FIGS. 15-16, a frame back retainer 10B, in another embodiment, incorporates the advantages and benefits of the above-mentioned frame back retainers 10, 10A (FIGS. 1-14). The frame back retainer 10B for a multi-use frame includes a tab-like structure 30B and a fastening structure 40B. The tab-like structure 30B defines an aperture 37B at a first end and defines a substantially flattened profile at a second end for engaging the multi-use frame, more specifically with a frame kerf between a frame back and the frame. In one embodiment, the frame back retainer 10B is mounted or attached to the frame back for engaging the frame.

The tab-like structure 30B includes at least one securing arm 32B,34B depending from a surface of the tab-like structure 30B near the aperture 37B. The at least one securing arm 32B,34B, in one embodiment, is two sets of two securing arms diametrically opposed to one another. Each set of two securing arms shares a common base area and depends from a common portion of the tab-like structure. In another embodiment, a first set of two securing arms is positioned at 0 degrees and a second set of two securing arms is positioned at 180 degrees. Of course it should be noted that other positions of the securing arms may be used than those stated above.

The tab-like structure 30B includes an angular offset portion 31B between the second end and the fastening structure 40B to spring-bias the tab-like structure. As a result of the angular offset portion, the tab-like structure has spring-bias to facilitate engagement within the kerf of the frame. In one embodiment, the tab-like structure is spring-biased upwardly. By offsetting the tab-like structure, a user may use the frame back and the frame with or without matting materials due to the spring-bias of the tab-like structure.

The angular offset portion 31B has a substantially raised profile for manipulation by a user. The angular offset portion may include one or more angular offset portions. The angular offset portion, in one embodiment, consists of a first angular offset portion, a substantially flattened top portion, and a second angular offset portion. The first angular offset portion depends upwardly from a horizontal axis of the first end. In one embodiment, the first angular offset portion is greater than 0 degrees but less than 90 degrees relative to the horizontal axis of the first end. For example, the first angular offset portion may be 45 degrees relative to the horizontal axis of the first end.

The substantially flattened portion, in one embodiment, is positioned along a substantially horizontal axis parallel to the horizontal axis of the first end. The substantially flattened portion has a substantially raised profile for manipulation by a user in rotating the tab-like structure. In one embodiment, the second angular offset portion depends downwardly from the horizontal axis of the substantially flattened portion and towards the horizontal axis of the first end. The second end positioned on a horizontal axis between the horizontal axis of the first end and the horizontal axis of the flattened top portion of the angular offset portion.

The fastening structure 40B is positioned through the aperture 37B of the tab-like structure 30B and mounted to the multi-use frame. The fastening structure 30B defines a raised pedestal profile from a surface of the multi-use frame for allowing rotation of the tab-like structure relative to the fastening structure. The at least one securing arm 32B,34B engages an outer edge of the fastening structure to rotatably attach the fastening structure to the tab-like structure. In one embodiment, a surrounding area of the aperture 37B is configured to seat the fastening structure 40B—such as a swivel rosette fastener element 42B with a tiered or raised pedestal profile. The surrounding area of the aperture 37B is a recessed region to securely seat a swivel rosette fastener element 42B with a raised or tiered pedestal profile.

In operation, the user rotates the tab-like structure 30B relative to the fastening structure 40B about an axis to engage or disengage the second end of the tab-like structure 30B within the frame kerf of the multi-use frame to secure the frame back to the frame. In operation, a user manipulates the angular offset portion 31B to rotate the tab-like structure 30B relative to the fastening structure 40B about an axis to engage or disengage the second end of the tab-like structure within the kerf. When the tab-like structure is engaged within the kerf or peripheral groove of the frame, the second end of the tab-like structure is frictionally fit within the kerf to prevent the removal of the frame back from the frame. When the tab-like structure is swiveled or moved out of the kerf, the second end of the tab-like structure is removed from the kerf and the frame back can be removed from the frame.

It would be appreciated by those skilled in the art that various changes and modifications can be made to the illustrated embodiments without departing from the spirit of the present invention. All such modifications and changes are intended to be covered by the appended claims.

What is claimed is:

1. A retainer for a multi-use frame, comprising:

a tab-like structure having a first end and second end, the first end defining an aperture, the second end having a substantially flattened profile for engaging the multi-use frame, the tab-like structure including at least one securing arm depending from a surface of the tab-like structure near the aperture;

a fastening structure positioned through the aperture of the tab-like structure and attached to the multi-use frame, the fastening structure defining a raised pedestal profile from a surface of the frame for allowing rotation of the tab-like structure relative to the fastening structure, the at least one securing arm engaging an outer edge of the fastening structure to rotatably attach the fastening structure to the tab-like structure; and wherein a user rotates the tab-like structure relative to the fastening structure about an axis to engage or disengage the second end of the tab-like structure within the multi-use frame.

2. The retainer of claim 1, wherein the tab-like structure includes an angular offset portion between the first end and the fastening structure to spring-bias the tab-like structure.

3. The retainer of claim 2, wherein the angular offset portion has a substantially raised profile for manipulation by a user.

4. The retainer of claim 1, wherein the at least one securing arm is two sets of two securing arms diametrically opposed to one another.

5. The retainer of claim 4, wherein each set of two securing arms shares a common base area and depends from a common portion of the tab-like structure.

6. The retainer of claim 4, wherein a first set of two securing arms is positioned at 0 degrees and a second set of two securing arms is positioned at 180 degrees.

7. A multi-use frame, comprising:

a frame and frame back;

a frame back retaining mechanism mounted to the frame back, the retaining mechanism including a tab-like structure having a first end and a second end, the first end defining an aperture, the second end having a substantially flattened profile for engaging the multi-use frame, the tab-like structure including at least one securing arm depending from a surface of the tab-like structure near the aperture;

a fastening structure positioned through the aperture of the tab-like structure and mounted to the frame back, the fastening structure defining a raised pedestal profile from a surface of the frame for allowing rotation of the tab-like structure relative to the fastening structure, the at least one securing arm engaging an outer edge of the fastening structure to rotatably attach the fastening structure to the tab-like structure; and wherein a user rotates the tab-like structure relative to the fastening structure about an axis to engage or disengage the second end of the tab-like structure within a frame kerf between the frame back and the frame.

8. The retainer of 7, wherein the tab-like structure includes an angular offset portion between the second end and the fastening structure to spring-bias the tab-like structure.

9. The retainer of claim 7, wherein the angular offset portion has a substantially raised profile for manipulation by a user.

* * * * *